United States Patent [19]

Edmunds

[11] Patent Number: 4,878,093

[45] Date of Patent: Oct. 31, 1989

[54] DUAL ROLL CLEANING APPARATUS FOR CHARGE RETENTIVE SURFACE

[75] Inventor: Cyril G. Edmunds, Webster, N.Y.

[73] Assignee: Xerox Corporation, Stamford, Conn.

[21] Appl. No.: 258,264

[22] Filed: Oct. 3, 1988

[51] Int. Cl.[4] ..... G03G 15/00

[52] U.S. Cl. ..... 355/296; 355/297; 355/298; 355/302

[58] Field of Search ..... 355/296, 297, 298, 302

[56] References Cited

U.S. PATENT DOCUMENTS

| | | | |
|---|---|---|---|
| 3,795,025 | 3/1974 | Sadamitsu | 15/256.52 |
| 3,807,853 | 4/1974 | Hudson | 355/15 |
| 3,947,108 | 3/1976 | Thettu et al. | 355/15 |
| 3,957,509 | 5/1976 | McMullen et al. | 96/1 R |
| 3,969,785 | 7/1976 | Ogawa et al. | 355/302 X |
| 4,071,296 | 1/1978 | Ermel et al. | 355/302 |
| 4,134,673 | 1/1979 | Fisher | 355/15 |
| 4,230,406 | 10/1980 | Klett | 355/15 |
| 4,264,190 | 4/1981 | Tsuda et al. | 355/302 |
| 4,392,742 | 7/1983 | Landa | 355/296 |
| 4,436,054 | 3/1984 | Ceelen et al. | 118/652 |
| 4,439,035 | 3/1984 | Landa | 355/15 |
| 4,622,914 | 11/1986 | Garris | 118/77 |
| 4,664,505 | 5/1987 | Itaya et al. | 355/302 X |
| 4,673,284 | 6/1987 | Matsumoto et al. | 355/302 X |
| 4,739,370 | 4/1988 | Yoshida et al. | 355/296 |
| 4,761,672 | 8/1988 | Parker et al. | 355/14 D |

OTHER PUBLICATIONS

Kane, "Apparatus for Reducing Photoreceptor Filming", Xerox Disclosure Journal, vol. 2, No. 4, Jul.-/Aug., 1977, p. 85.

Fisher, "Modified Dual Brush Cleaner", Xerox Disclosure Journal, vol. 2, No. 3, May/Jun. 1977, p. 85-86.

*Primary Examiner*—A. C. Prescott

*Attorney, Agent, or Firm*—Mark Costello

[57] ABSTRACT

A cleaning housing supports in cleaning relationship a closely spaced combination of an upstream brush roll cleaner and an adjacent downstream foam or poromeric roll cleaner. Subsequent to release of toner from the surface, toner is carried away from the charge retentive surface on the fibers of the brush or the surface of the foam rolls. A blower creates a directed air flow for the removal of toner from the cleaning rolls. Mechanical toner removal devices may also be used to release toner from the roll surfaces. The brush roll cleaner provides a primary cleaning function, while the foam roll cleaner provides a secondary cleaning function as a back up to the brush roll cleaner and an abrading function for the removal of film buildup on the charge retentive surface.

9 Claims, 2 Drawing Sheets

DUAL ROLL CLEANING APPARATUS FOR CHARGE RETENTIVE SURFACE

Figure 1:
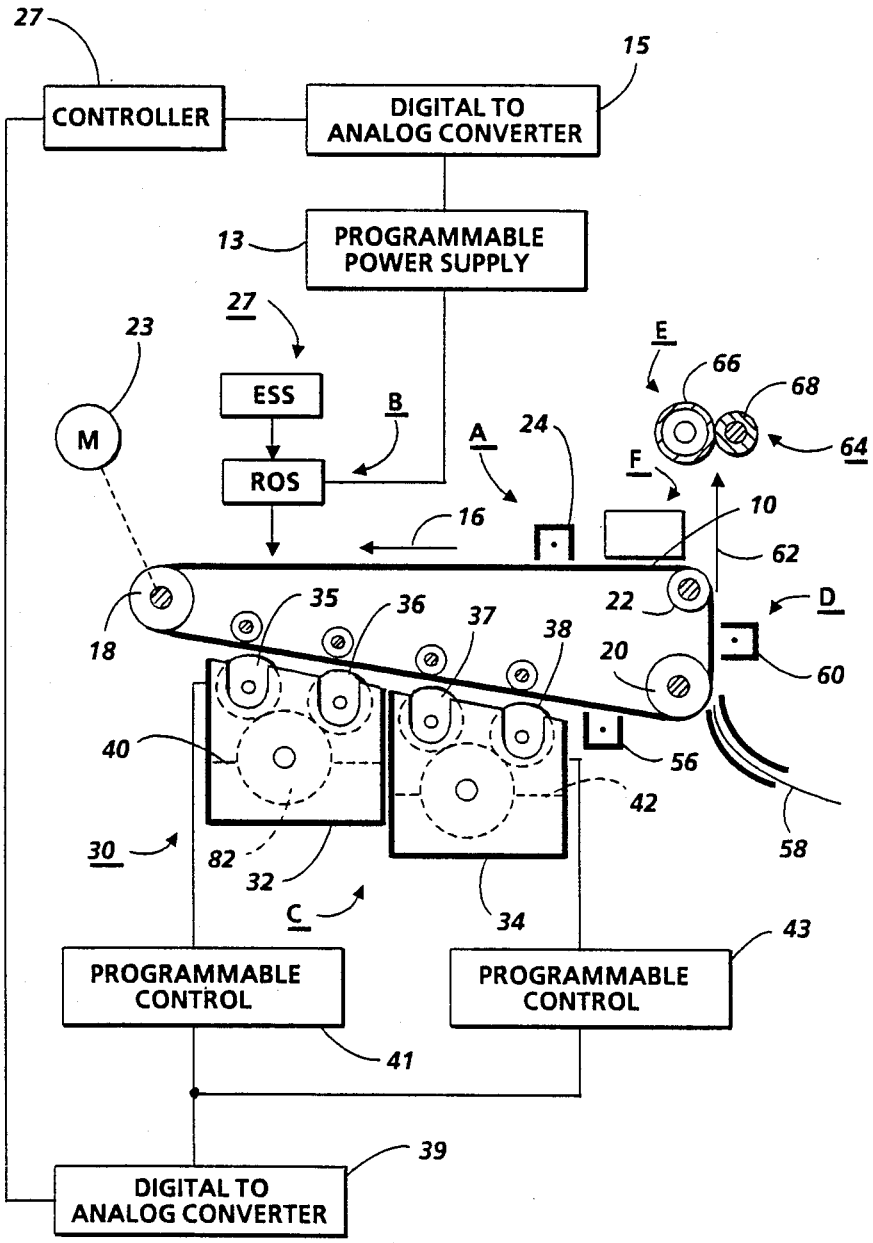

This invention relates to reproduction apparatus and more particularly to cleaning apparatus for removing residual toner and debris from a charge retentive surface forming a part of the reproduction apparatus.

INCORPORATION BY REFERENCE

The following patents and publications are incorporated herein by reference for their teachings: U.S. Pat. No. 3,795,025 to Sadamitsu; U.S. Pat. No. 3,807,853 to Hudson; U.S. Pat. No. 3,947,108 to Thettu et al.; U.S. Pat. No. 3,957,509 to McMullen et al.; U.S. Pat. No. 4,134,673 to Fisher; U.S. Pat. No. 4,230,406 to Klett; U.S. Pat. No. 4,436,054 to Ceelen et al.; U.S. Pat. No. 4,439,035 to Landa; U.S. Pat. No. 4,622,914 to Garris; U.S. patent application No. 160,434 to Lindblad et al., filed Feb. 23, 1988 and assigned to the same assignee as the present invention; Xerox Disclosure Journal, "Apparatus for Reducing Photoreceptor Filming", Thomas J. Kane, Vol. 2, No. 4, July/August 1977, p. 85; and Xerox Disclosure Journal, "Modified Dual Brush Cleaner", Donald J. Fisher, Vol. 2, No. 3, May/June 1977, pp. 85,86. U.S. Pat. No. 4,761,672 to Parker et al. is incorporated by reference for its teaching of highlight color development.

BACKGROUND OF THE INVENTION

In electrophotographic applications such as xerography, a charge retentive surface is electrostatically charged, and exposed to a light pattern of an original image to be reproduced to selectively discharge the surface in accordance therewith. The resulting pattern of charged and discharged areas on that surface form an electrostatic charge pattern (an electrostatic latent image) conforming to the original image. The latent image is developed by contacting it with a finely divided electrostatically attractable powder referred to as "toner". Toner is held on the image areas by the electrostatic charge on the surface. Thus, a toner image is produced in conformity with alight image of the original being reproduced. The toner image may then be transferred to a substrate (e.g., paper), and the image affixed thereto to form a permanent record of the image to be reproduced. Subsequent to development, excess toner left on the charge retentive surface is cleaned from the surface. The process is well known, and useful for light lens copying from an original, and printing applications from electronically generated or stored originals, where a charged surface may be imagewise discharged in a variety of ways.

Although a preponderance of the toner forming the image is transferred to the paper during transfer, some toner invariably remains on the charge retentive surface, it being held thereto by relatively high electrostatic and/or mechanical forces. Additionally, paper fibers, Kaolin and other debris have a tendency to be attracted to the charge retentive surface. It is essential for optimum operation that the toner remaining on the surface be cleaned thoroughly therefrom.

A commercially successful mode of cleaning employed in automatic xerography utilizes a brush with soft fiber bristles which have suitable triboelectric characteristics. While the bristles are soft they are sufficiently firm to remove residual toner particles from the charge retentive surface. For more effective cleaning, dual brush cleaning arrangements have been proposed, wherein a pair of brushes are located within a housing, as shown for example in U.S. Pat. Nos. 3,795,025 to Sadamitsu, 4,134,673 to Fisher, Xerox Disclosure Journal, Modified Dual Brush Cleaner, Donald J. Fisher, Vol. 2, No. 3, May/June 1977, pp. 85, 86. Dual brush arrangements are known for other purposes as well, such as for applying surface treatment materials to the a charge retentive surface, as shown in U.S. Pat. No. 4,622,914 to Garris. In a dual brush arrangement, flicker bars and directed air flow are used to remove toner from the brush rolls.

In certain electrophotographic processes, and particularly in highlight color applications that provide two types of toner to develop latent images on a surface, a phenomenon of filming is noted. Filming is characterized by the tenacious adherence of very fine toner material residues, toner additives and paper debris to the charge retentive surface. For reasons that are not clearly understood, brush cleaning is not an effective cleaning device in systems where a high degree of filming is present. Film cleaning can be improved in brush cleaners by stiffening the brush fibers, but film still remains on the surface.

To alleviate the filming problem, an abrasive surface or cutting edge is commonly used to remove the film. Accordingly, U.S. patent application No. 160,434 to Lindblad et al. filed Feb. 23, 1988, and assigned to the same assignee as the present invention, shows an auger arrangement providing porous foam or poromeric surfaces, or cutting edges for the removal of film buildup. U.S. Pat. No. 3,807,853 to Hudson, and U.S. Pat. No. 4,230,406 to Klett, for dry toner, while U.S. Pat. No. 4,436,054 to Ceelen et al. and U.S. Pat. No. 4,439,035 to Landa suggest the use of foam cleaning rolls for liquid toner. Dual foam rolls with porous surfaces are also proposed, as in U.S. Pat. No. 3,807,853 to Hudson, perhaps having different surface porosity or absorbing characteristics. Poromeric materials tend to collect toner in the pores of the material, which in movement past the charge retentive surface have the tendency to abrade or scour the surface. A light scouring or abrading action is desirable, but too heavy a scouring action will tend to damage coatings on the charge retentive surface. However, when a foam roll is arranged to provide an adequate cleaning function, it proves to be excessively abrasive, and may damage a soft photoconductive layer on a charge retentive surface.

Combination of other cleaning devices with foam rolls have been proposed, combining the abrasive properties of foam rolls with the better cleaning properties of other cleaning devices such as blades or brushes. Thus for example, Xerox Disclosure Journal, "Apparatus for Reducing Photoreceptor Filming", Thomas J. Kane, Vol. 2, No. 4, July/August 1977, p. 85, shows an foam roll preceding a brush cleaner, while U.S. Pat. No. 3,947,108 to Thettu suggests the foam roll following a blade. However, placing the foam roll preceding the fiber brush, as in U.S. Pat. No. 3,947,108 to Thettu, loads the roll with too much toner, creating the potential for too much abrasion or scouring. Use of the foam member after the blade, as in "Apparatus for Reducing Photoreceptor Filming", while providing appropriate abrasion, does not utilize the cleaning action of a roll cleaner in the cleaning arrangement.

Redundant cleaning systems are commonly used to improve cleaning quality by allowing a stressed primary system to operate in a less than perfect mode, and using a secondary system to make certain that the surface is completely cleaned. Thus, for example, U.S. Pat. No. 3,957,509 to McMullen et al. shows the combination of a blade preceding a stiff brush; U.S. Pat. No. 3,947,108 to Thettu suggests the foam roll following a blade; Xerox Disclosure Journal, "Apparatus for Reducing Photoreceptor Filming", Thomas J. Kane, Vol. 2, No. 4, July/August 1977, p. 85, shows a foam roll preceding a brush cleaner; U.S. Pat. No. 3,795,025 to Sadamitsu, U.S. Pat. No. 4,134,673 to Fisher, and Xerox Disclosure Journal, "Modified Dual Brush Cleaner", Donald J. Fisher, Vol. 2, No. 3, May/June 1977, pp. 85, 86, show dual brush arrangements; U.S. Pat. No. 3,807,853 to Hudson shows a dual foam roll arrangement.

SUMMARY OF THE INVENTION

In accordance with the invention there is provided an improved cleaning device for removal of toner from a charge retentive surface or photoreceptor surface, providing improved film removal, and using redundant cleaning systems.

In accordance with one aspect of the invention, a cleaning housing supports in cleaning relationship a closely spaced combination of an upstream brush roll cleaner and an adjacent downstream foam or foam roll cleaner. Subsequent to release of toner from the surface, it is carried away from the charge retentive surface on the fibers of the brush or the surface of the foam rolls and an air flow system removes the toner from the fibers or roll surface for transport away from the cleaning system.

The foam roll surface collects toner in the pores thereof, abrade the charge retentive surface for film removal as the roll rotates past the surface. The cleaning action of the foam roll is utilized for toner removal as well as film removal, thus adding the advantage of the redundant cleaning systems. The foam roll is arranged downstream so that is is not overloaded with toner, which might undesirably increase its abrading characteristics. Additionally, the arrangement allows the more effective brush cleaner, which also provides better toner release characteristics, to be in the stressed primary cleaning position, for which it is better suited, while the foam roll is used in the secondary, less stressed cleaning position.

Figure 2:
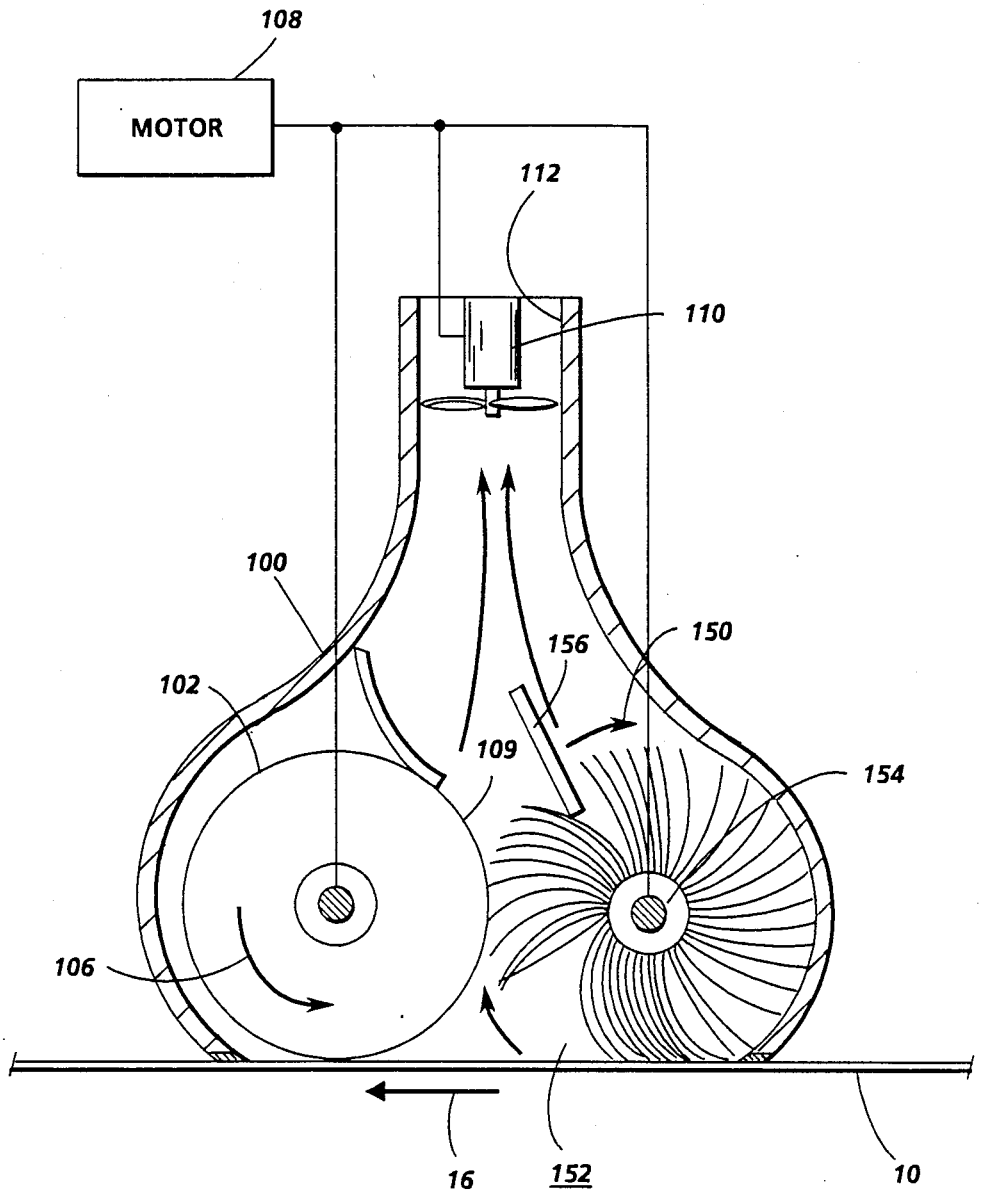

These and other aspects of the invention will become apparent from the following description used to illustrate a preferred embodiment of the invention read in conjunction with the accompanying drawings in which:

FIG. 1 is a schematic elevational view depicting an electrophotographic printing machine incorporating the present invention; and FIG. 2 is a schematic illustration of a cleaner incorporated in the machine of FIG. 1.

Referring now to the drawings, where the showings are for the purpose of describing a preferred embodiment of the invention and not for limiting same, the various processing stations employed in the printing machine illustrated in FIG. 1 will be described only briefly. It will no doubt be appreciated that the various processing elements also find advantageous use in any electrophotographic device, including copier or printer applications where filming is a problem. Even where filming is not a problem, the described invention will find advantageous use as a cleaning device.

As shown in FIG. 1, a printing machine incorporating my invention may utilize a charge retentive member in the form of a photoconductive belt 10 having a photoconductive surface and an electrically conductive substrate and mounted for movement past a charging station A, an exposure station B, developer stations C, transfer station D and cleaning station F. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used as a drive roller and the latter of which can be used to provide suitable tensioning of the photoreceptor belt 10. Motor 23 rotates roller 18 to advance belt 10 in the direction of arrow 16. Roller 18 is coupled to motor 23 by suitable means such as a belt drive.

As can be seen by further reference to FIG. 1, initially successive portions of belt 10 pass through charging station A. At charging station A, a corona discharge device such as a scorotron, corotron or dicorotron indicated generally by the reference numeral 24, charges the belt 10 to a selectively high uniform positive or negative potential. Preferably charging is negative. Any suitable control, well known in the art, may be employed for controlling the corona discharge device 24.

Next, the charged portions of the photoreceptor surface are advanced through exposure station B. At exposure station B, the uniformly charged photoreceptor or charge retentive surface 10 is exposed to a laser based input and/or output scanning device 25 which causes the charge retentive surface to be discharged in accordance with the output from the scanning device. Preferably the scanning device is a three level laser Raster Output Scanner (ROS). The ROS output is set via a programmable power supply 26 which is driven by means of a controller 27 via a digital to analog converter 28. Alternatively, the ROS could be replaced by a conventional xerographic exposure device.

The photoreceptor, which is initially charged to a voltage $V_o$, undergoes dark decay to a level $V_{ddp}$. When exposed at the exposure station B, it is discharged to $V_W$ imagewise in the background (white) image areas and to $V_c$ which is near zero or ground potential in the highlight (i.e. color other than black) color parts of the image.

At development station C, a magnetic brush development system, indicated generally by the reference numeral 30 advances developer materials into contact with the electrostatic latent images. The development system 30 comprises first and second developer housings 32 and 34. Preferably, each magnetic brush development housing includes a pair of magnetic brush developer rollers. Thus, the housing 32 contains a pair of rollers 35, 36 while the housing 34 contains a pair of magnetic brush rollers 37, 38. Each pair of rollers 38 advances its respective developer material into contact with the latent image. Each developer roller pair forms a brush-like structure comprising toner particles which are attracted therefrom by the latent electrostatic images on the photoreceptor.

Appropriate developer biasing is accomplished via programmable power controls 41 and 43 electrically connected to respective developer housings 32 and 34 and the controller 27, connection of the controller to the developer housings being via a digital-to-analog converter 39. An appropriate program stored in fixed memory of the controller for the developer housing, applied through a digital-to-analog converter and a programmable power supply, will cause the developer rolls, at the appropriate times, to rotate in one direction to effect image development or in the opposite direction for causing the developer to cease contact with the photoreceptor. For example, during cycle-up and cycle-down, the rolls are made to rotate in the direction for ceasing developer contact with the photoreceptor. Rotation in the developing direction is accomplished from the time when cycle-up has been completed to just prior to cycle-down.

Other suitable programs stored in the fixed memory of the controller may be used for ensuring proper toner/carrier triborelationships by causing rotation of the developer rolls in the developing direction at a time when this can be accomplished without actually developing images on the photoreceptor.

Color discrimination in the development of the electrostatic latent image is achieved by passing the photoreceptor past the two developer housings 32 and 34 in a single pass with the magnetic brush rolls 35, 36, 37 and 38 electrically biased to voltages which are offset from the background voltage $V_W$, the direction of offset depending on the polarity of toner in the housing. One housing e.g. 32 (for the sake of illustration, the first) contains developer with black toner 40 having a triboelectric properties such that the toner is driven to the most highly charged areas of the latent image by the development field between the photoreceptor and the biased development rolls. Conversely, the triboelectric charge on colored toner 42 in the second housing is chosen so that the toner is urged towards parts of the latent image at residual potential, by the development field existing between the photoreceptor and the development rolls in the second biased housing at bias voltages.

A sheet of support material 58 is moved into contact with the toner image at transfer station D. The sheet of support material is advanced to transfer station D by conventional sheet feeding apparatus, not shown. Preferably, sheet feeding apparatus includes a feed roll contacting the uppermost sheet of a stack of copy sheets. Feed rolls rotate so as to advance the uppermost sheet from a stack into a chute which directs the advancing sheet of support material into contact with photoconductive surface of belt 10 in a timed sequence so that the toner powder image developed thereon contacts the advancing sheet of support material at transfer station D.

Because the composite image developed on the photoreceptor contains both positive and negative toner, a pre-transfer corona discharge member 56 is provided to condition the toner for effective transfer to a substrate using corona discharge.

Transfer station D includes a corona generating device 60 which sprays ions of a suitable polarity onto the backside of sheet 58. This attracts the charged toner powder images from the belt 10 to sheet 58. After transfer, the sheet continues to move, in the direction of arrow 62, onto a conveyor (not shown) which advances the sheet to fusing station E.

Fusing station E includes a fuser assembly, indicated generally by the reference numeral 64, which permanently affixes the transferred powder image to sheet 58. Preferably, fuser assembly 64 comprises a heated fuser roller 66 and a back-up roller 68. Sheet 58 passes between fuser roller 66 and back-up roller 68 with the toner powder image contacting fuser roller 66. In this manner, the toner powder image is permanently affixed to sheet 58. After fusing, a chute, not shown, guides the advancing sheet 58 to a catch tray, also not shown, for subsequent removal from the printing machine by the operator After the sheet of support material is separated from the photoconductive surface of belt 10, the residual toner particles carried by the non-image areas on the photoconductive surface are removed therefrom. These particles are removed at cleaning station F, hereinafter described in greater detail.

Subsequent to cleaning, a discharge lamp (not shown) floods the photoconductive surface with light to dissipate any residual electrostatic charge remaining prior to the charging thereof for the successive imaging cycle.

As thus described, a printing or reproduction machine in accordance with the present invention may be any of several well known devices. Variations may be expected in specific processing, paper handling and control arrangements without affecting the present invention. However, the invention finds particular use in highlight or second toner applications, because the second toner types are often conducive to film development.

With reference now to FIG. 2, cleaning station F includes housing 100 supporting a plastic foam or poromeric cleaning roll 102 and brush cleaning roll 104 in cleaning relationship with belt 10. Foam cleaning roll 102 is supported downstream in process direction 16 from cleaning brush 104, journaled for rotating movement, and driven with a motor 108 in the counterclockwise direction 106. Foam cleaning roll 102 has an outer surface 109 with a large number of pores formed therein. As the porous surface of the roll collects toner from the surface of belt 10, toner particles lodge in the pores. As these toner particles are carried in the pores past the surface of belt 10, they tend to abrade or scour the surface, to removing accumulating films. Toner collecting on the roll surface 109 is carried out of the cleaning nip between foam roller 102 and belt 10 by the roll rotation, into an area where it may be collected by a directed airflow created, for example, by fan or blower 110 arranged in a toner removal passage 112, through which toner is directed for storage or return to the developer housing. A doctor blade 114 supported on a wall of housing 100 may be used to aid in the release of toner from the surface of the poromeric roll 102, as may other mechanical release devices useful in obtaining toner release from foam rolls.

Brush roll 104 is arranged to function as the primary cleaner of belt 10, journaled for rotating movement driven with a motor 108 in the clockwise direction 150, within housing 100 as shown. While the two cleaning rolls are shown, in this particular embodiment, to be connected to a common motor or driver, each may be provided with a separate motor, or in either case, be driven in rotating motion at distinct speeds. Brush roll 104 may have a large number of fibers, indicated generally as 152, supported on core 154. Toner is collected on brush fibers 152, and carried out of the cleaning nip with the motion of the roll, where it may be be collected by the directed airflow, created by fan or blower 110 and directed through toner removal passage 112. To aid in the release of the toner from fibers 152, which may strongly attracted thereto by triboelectric charging, a flicker bar 156 may be provided supported within housing 100 and arranged to contact the fibers of the brush roll.

Of course, other arrangements well known in the art could also be used to remove toner from the foam and brush rolls. For example, biased roll, contacting the cleaning rolls could be used to electrostatically remove toner from the rolls.

In combination, brush roll 104 is useful as a primary cleaner, while foam roll 102 is useful as a secondary cleaner. A toner-filled brush roll sometimes causes filming, and may not satisfactorily clean the surface of belt 10. Accordingly, the foam roll is arranged downstream from the brush roll to clean the surface to a satisfactory condition, and to also provide desirable abrasion of the surface. The interference of the fiber brush against the belt 10 may be selected to optimize cleaning and to distribute the cleaning function appropriately between the brush roll and foam roll, so that the foam roll is not required to perform in a manner that would produce undesirable abrasiveness.

The invention has been described with reference to a preferred embodiment. Obviously modifications will occur to others upon reading and understanding the specification taken together with the drawings. This embodiment is but one example, and various alternatives modifications, variations or improvements may be made by those skilled in the art from this teaching which are intended to be encompassed by the following claims.

I claim:

1. Reproduction apparatus including a charge retentive surface; image forming means for forming a latent image on the charge retentive surface; developing means for developing the latent image with toner; transfer means for transferring the developed toner image from the charge retentive surface to a support surface; and cleaning means for removing residual toner and debris from the charge retentive surface, said cleaning means comprising:

a cleaning housing;

a brush cleaning roll journaled for rotating movement within said housing and supported in cleaning relationship with the charge retentive surface;

an abrading foam cleaning roll journaled for rotating movement within said housing and supported in cleaning relationship with the charge retentive surface;

said foam cleaning roll arranged downstream from said brush cleaning roll member;

drive means for moving each of said foam cleaning roll and brush cleaning roll in said rotating movement, whereby movement thereof allows said foam cleaning roll and brush cleaning roll to collect toner and debris from the charge retentive surface;

means for removing toner from said foam cleaning roll and brush cleaning roll in said rotating movement, for transport to an output.

2. The apparatus as defined in claim 1, wherein said foam cleaning roll has a generally porous surface.

3. The apparatus as defined in claim 1, wherein said brush roll is provided a large number of fibers suitable for the collection of toner thereon.

4. The apparatus as defined in claim 1, wherein said toner removing means includes a blower for creating a directed air flow past said abrasive cleaning roll and said foam cleaning roll.

5. The apparatus as defined in claim 1 includhng mechanical means associated with at least one of said said foam cleaning roll and brush cleaning roll, to aid in the release of toner collected by said rolls.

6. Reproduction apparatus including a charge retentive surface; image forming means for forming a latent image on the charge retentive surface; developing means for developing the latent image with toner; transfer means for transferring the developed toner image from the charge retentive surface to a support surface; and cleaning means for removing residual toner and debris from the charge retentive surface, said cleaning means comprising:

a cleaning housing;

a brush cleaning roll journaled for rotating movement within said housing and supported in cleaning relationship with the charge retentive surface;

an abrading foam cleaning roll having a porous surface, journaled for rotating movement within said housing and supported in cleaning relationship with the charge retentive surface;

said foam cleaning roll arranged downstream from said brush cleaning roll member;

a motor for moving each of said foam cleaning roll and brush cleaning roll in said rotating movement, whereby movement thereof allows said foam cleaning roll and brush cleaning roll to collect toner and debris from the charge retentive surface;

a blower for providing a directed air flow past said foam cleaning roll and brush cleaning roll for the removal of toner therefrom and transport of said toner to an output.

7. The apparatus as defined in claim 6 including mechanical means associated with at least one of said said foam cleaning roll and brush cleaning roll, to aid in the release of toner collected by said rolls.

8. Reproduction apparatus including a charge retentive surface; image forming means for forming a latent image on the charge retentive surface; developing means for developing the latent image with toner; transfer means for transferring the developed toner image from the charge retentive surface to a support surface; and cleaning means for removing residual toner and debris from the charge retentive surface, said cleaning means comprising:

a cleaning housing;

a brush cleaning roll journaled for rotating movement within said housing, supported in cleaning relationship with the charge retentive surface and having a interference therewith selected to provided a primary cleaning function;

an abrading foam cleaning roll having a porous surface, journaled for rotating movement within said housing and supported in cleaning relationship with the charge retentive surface and having a interference therewith selected to provided a secondary clean function, and a film removing abrading function;

said foam cleaning roll arranged downstream from said brush cleaning roll member;

a motor for moving each of said foam cleaning roll and brush cleaning roll in said rotating movement, whereby movement thereof allows said foam cleaning roll and brush cleaning roll to collect toner and debris from the charge retentive surface;

a blower for providing a directed air flow past said foam cleaning roll and brush cleaning roll for the removal of toner therefrom and transport of said toner to an output.

9. The apparatus as defined in claim 8 including mechanical means associated with at least one of said said foam cleaning roll and brush cleaning roll, to aid in the release of toner collected by said rolls.

* * * * *